US005766048A

United States Patent [19]

Iwashita

[11] Patent Number: 5,766,048

[45] Date of Patent: Jun. 16, 1998

[54] EXHAUST SYSTEM FOR OUTBOARD DRIVE

[75] Inventor: Takashi Iwashita, Hamamatsu, Japan

[73] Assignee: Sanshin Kogyo Kabushiki Kaisha, Shizuoka, Japan

[21] Appl. No.: 658,652

[22] Filed: Jun. 5, 1996

[30] Foreign Application Priority Data

Jun. 5, 1995 [JP] Japan ..... 7-137847

[51] Int. Cl.[6] ..... B63H 21/32

[52] U.S. Cl. ..... 440/89; 440/80

[58] Field of Search ..... 440/89, 80, 81; 416/93 R, 93 A, 93 M, 129 R, 129 A

[56] References Cited

U.S. PATENT DOCUMENTS

| | | | |
|---|---|---|---|
| 2,672,115 | 3/1954 | Conover | 440/80 |
| 3,434,447 | 3/1969 | Christensen et al. . | |
| 4,545,771 | 10/1985 | Iio . | |
| 4,790,782 | 12/1988 | McCormick | 440/81 |
| 4,793,773 | 12/1988 | Kinouchi et al. . | |
| 4,832,570 | 5/1989 | Solia | 416/129 A |
| 4,871,334 | 10/1989 | McCormick . | |
| 4,911,665 | 3/1990 | Hetzel . | |
| 5,230,644 | 7/1993 | Meisenburg et al. . | |
| 5,344,349 | 9/1994 | Meisenburg et al. . | |
| 5,352,141 | 10/1994 | Shields et al. . | |
| 5,529,520 | 6/1996 | Iwashita et al. . | |

FOREIGN PATENT DOCUMENTS 63-103792 5/1988 Japan .

*Primary Examiner*—Sherman Basinger
*Attorney, Agent, or Firm*—Knobbe, Martens, Olson & Bear, LLP

[57] ABSTRACT

An exhaust system for an marine drive discharges exhaust gases between front and rear propellers of a counter-rotating propeller system. The discharge of exhaust gases between the propellers produces a cavitation effect about the rear propeller when accelerating from low speeds. As a result, the drive of the propellers accelerates more rapidly. At high speeds, however, the velocity of the exhaust gases carries the gases over the rear propeller principally in the vicinity of the rear propeller hub. No substantial cavitation effect occurs about the blades of the rear propeller at high speeds. As a result, the discharge of exhaust gases between the propellers causes no significant loss of propulsion efficiency when traveling at high speeds.

30 Claims, 8 Drawing Sheets

EXHAUST SYSTEM FOR OUTBOARD DRIVE

BACKGROUND OF THE INVENTION

1. Field of the Invention

The present invention relates in generally to an outboard drive, and more particularly to an improved exhaust discharge system for an outboard drive.

2. Description of Related Art

Many marine propulsion systems now employ a counter-rotating propeller device. Front and rear propellers of the system, which are of opposite hand and which rotate in opposite directions about a common drive axis, together produce a forward driving thrust. This dual propeller arrangement provides improved propulsion efficiency and enhances the handling characteristics of the watercraft.

Counter-rotating propeller devices, however, place a large load on the engine of the marine propulsion system. The drag of the two propellers significantly reduces the ability of the engine to quickly accelerate the propellers. Propeller blade acceleration consequently suffers. The blades take longer to accelerate to a desired rotational speed. As a result, the marine propulsion system takes longer to get the associated watercraft up on plane (i.e., planing over the surface of the body of water in which the watercraft is operated).

The placement of propellers in series also tends to increase the length of the exhaust path from the engine to a discharge end of the exhaust system, typically located behind the rear propeller. In prior counter-rotating propeller systems, the exhaust system conveys engine exhaust through the hubs of both propellers and discharges the engine exhaust at the rear end of the rear propeller. The inclusion of the second propeller thus effectively lengthens the exhaust path.

A longer exhaust path leads to increased back pressure within the exhaust system. High back pressure substantially reduces the in-cylinder fill capacity of the engine. Less fresh fuel charge thus is delivered to the cylinder and engine performs suffers as a result.

In some applications, counter-rotating propeller systems have been mounted high on the watercraft to run the propellers partially surfaced, i.e., to position the propellers so as to rotate at least partially above the surface of the body of water in which the watercraft is operated. With this mounting arrangement, however, the exhaust system discharges exhaust gases directly to the atmosphere. The known silencing effect obtaining by submerged exhaust discharge is lost. The marine propulsion system consequently sounds louder.

SUMMARY OF THE INVENTION

A need therefore exists for a simply-structured exhaust system for use with a counter-rotating propulsion device which reduces the drag resistance on the rear propeller during acceleration to allow the propulsion system to accelerate the watercraft more rapidly. The exhaust system desirably maintains submerged discharge of the exhaust gases even when an associated propulsion device runs partially surfaced.

An aspect of the present invention thus involves a marine drive for a watercraft including a propulsion device. The propulsion device comprises a front propeller and a rear propeller which are intended to rotate in opposite directions about a common rotational axis. Each of the propellers include a generally tubular outer hub from which at least one propeller blade extends. The outer hub of the front propeller has an inner diameter that is larger than an outer diameter of the rear propeller hub.

In accordance with another aspect of the present invention, a marine device for a watercraft is provided. The marine device includes an engine that drives a propulsion device. The propulsion device comprises a front propeller and a rear propeller which are juxtaposed and rotate in opposite directions about a common rotational axis. An exhaust system communicates with the engine and conveys exhaust gases from the engine to a discharge end of the exhaust system. The discharge end is positioned to discharge exhaust gases in the vicinity of juxtaposed ends of the front and rear propellers.

An additional aspect of the present invention involves a marine drive for a watercraft. The marine drive comprises an engine driving a propulsion device that includes at least one propeller. The propeller rotates about a drive axis. An exhaust system communicates with the engine and discharges exhaust gases through the propeller. The exhaust system comprises an exhaust discharge conduit formed within a lower unit. The lower unit supports the propulsion device. The exhaust system also includes an annular exhaust passage which is formed within the propeller and which communicates with an outlet of the exhaust discharge conduit. The outlet is positioned generally below the drive axis.

Another aspect of the present invention involves a marine drive for a watercraft comprising an engine. The engine drives a propulsion device that includes at least one propeller which rotates about a drive axis. A lower unit supports the propeller in a position to run at least partially exposed above a surface of a body of water in which the watercraft is operated when the watercraft is up on plane. An exhaust system communicates with the engine and discharges exhaust gases through the propeller. The exhaust system comprises an annular discharge opening defined on a rear side of the lower unit. The annular opening is positioned about the drive axis. An exhaust passage is formed within the propeller and also is positioned about the drive axis in a position juxtaposing an inlet to the exhaust passage with the annular opening of the lower unit. A wall covers a portion of the annular opening which is exposed above the surface of the water when the watercraft is up on plane.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF PREFERRED EMBODIMENTS

Figure 1:
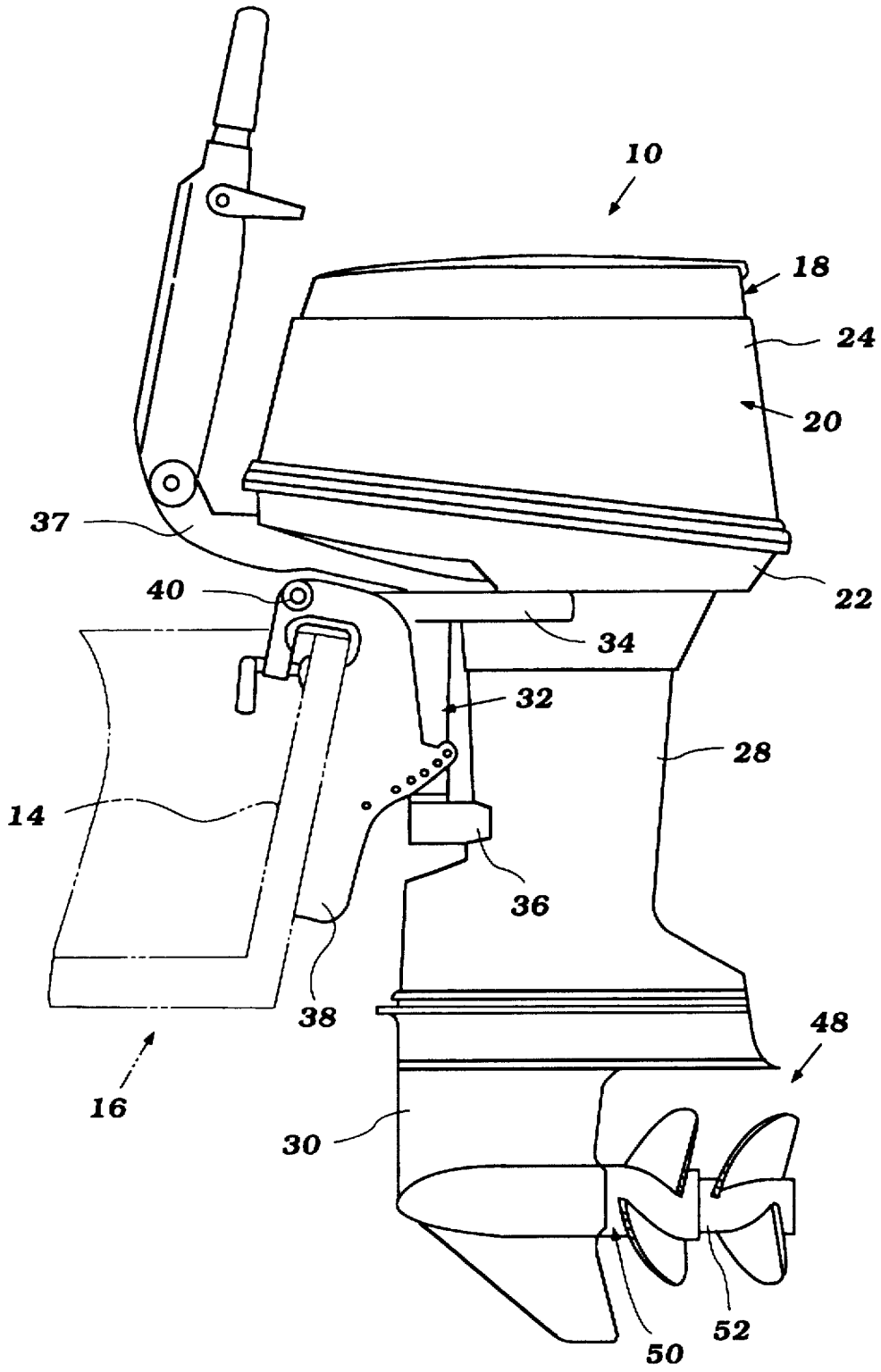
FIG. 1 is a side elevational view of a marine drive which embodies an exhaust discharge system configured in accordance with a preferred embodiment of the present invention.

FIG. 1 illustrates a marine drive 10 which incorporates an exhaust system (indicated generally by reference numeral 12 in FIG. 2) that is configured in accordance with a preferred embodiment of the present invention. In the illustrated embodiment, the marine drive 10 is depicted as an outboard motor for mounting on a transom 14 of a watercraft 16. It is contemplated, however, that those skilled in the art will readily appreciate that the present invention can be applied to stern drive units, to inboard drive units and to other types of watercraft drive units as well. Thus, as used herein, "marine drive" generically means an outboard motor, a stern drive, an inboard drive, and all similar marine propulsion systems and devices.

In the illustrated embodiment, the marine drive 10 has a power head 18 which includes an engine (not shown). A conventional protective cowling 20 surrounds the engine. The cowling 20 desirably includes a lower tray 22 and a top cowling member 24. These components 22, 24 of the protective cowling 20 together define an engine compartment which houses the engine.

The engine is mounted conventionally with its output shaft (i.e., crankshaft) rotating about a generally vertical axis. The crankshaft (not shown) drives a drive shaft 26 (see FIG. 2), as known in the art. The drive shaft 26 depends from the power head 18 of the marine drive 10.

A drive shaft housing 28 extends downward from the lower tray 20 and terminates in a lower unit 30. As understood from FIG. 2, the drive shaft 26 extends through and is journaled within the drive shaft housing 28.

A steering shaft assembly 32 is affixed to the drive shaft housing 28 by upper and lower brackets 34, 36. The brackets 34, 36 support the steering shaft assembly 32 for steering movement. Steering movement occurs about a generally vertical steering axis which extends through a shaft of the steering shaft assembly 32, as known in the art. A steering arm 37 which is connected to an upper end of the steering shaft can extend in a forward direction for manual steering of the marine drive 10, as known in the art.

The steering shaft assembly 32 also is pivotably connected to a clamping bracket 38 by a pin 40. The clamping bracket 38, in turn, is configured to attached to the transom 14 of the watercraft 16. This conventional coupling permits the marine drive 10 to be pivoted relative to the pin 40 to permit adjustment of the trim position of the marine drive 10 and for tilt-up of the marine drive 10.

Although not illustrated, it is understood that a conventional hydraulic tilt and trim cylinder assembly, as well as a conventional hydraulic steering cylinder assembly can be used as well with the present marine drive 10. The construction of the steering and trim mechanism is considered to be conventional and, for that reason, further description is not believed necessary for appreciation and understanding of the present invention.

Figure 2:
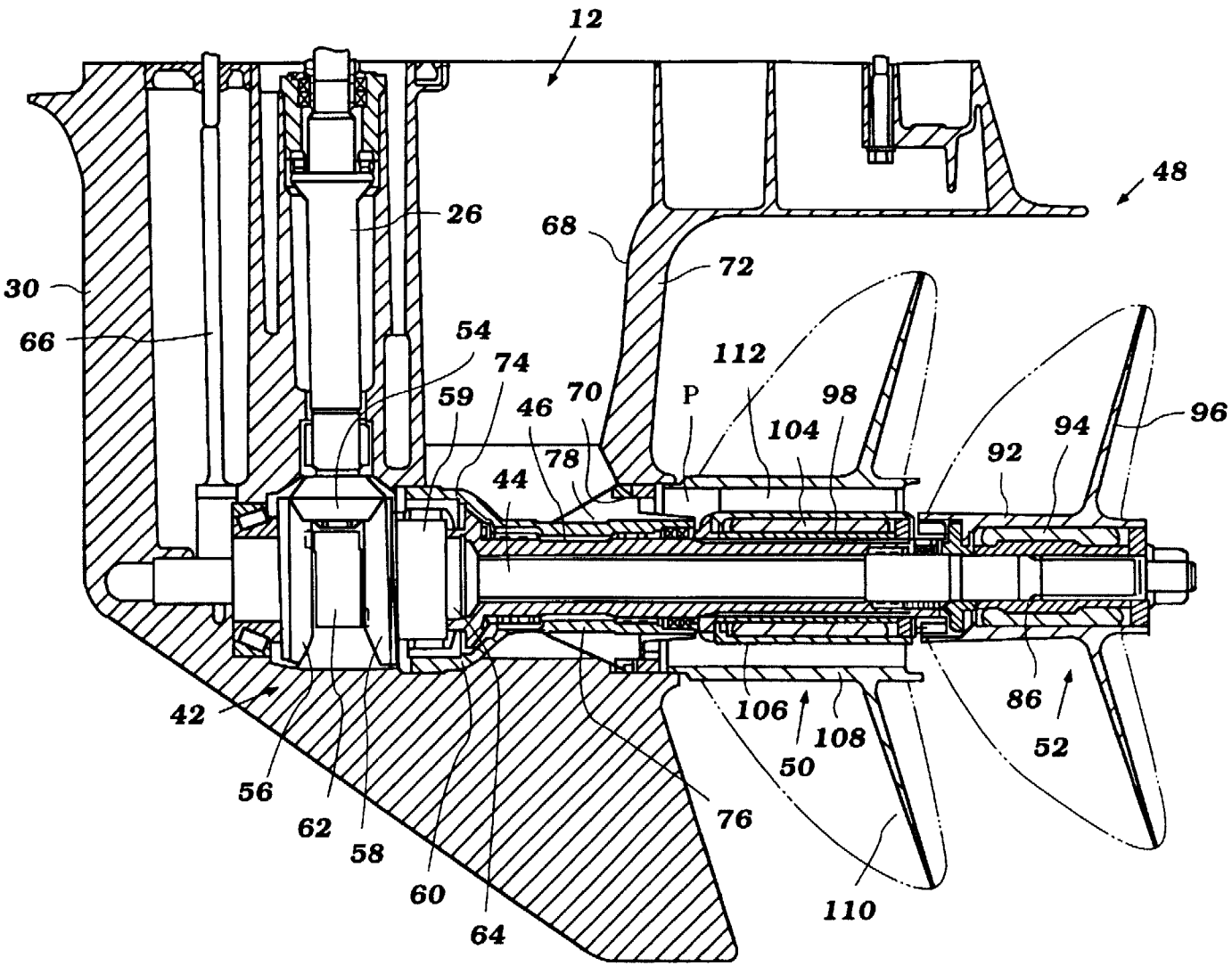
FIG. 2 is a sectional side elevational view of a lower unit and a propulsion device of the outboard drive of FIG. 1.

As illustrated in FIG. 2, the drive shaft 26 extends from the drive shaft housing 28 into the lower unit 30 where a transmission 42 selectively couples the drive shaft 26 to an inner propulsion shaft 44 and to an outer propulsion shaft 46. The transmission 42 advantageously is a forward/neutral/reverse-type transmission. In this manner, the drive shaft 26 drives the inner and outer propulsion shafts 44, 46 (which rotate in a first direction and in a second counter direction, respectively) in any of these operational states, as described below in detail.

The propulsion shafts 44, 46 drive a propulsion device 48. In the illustrated embodiment, the propulsion device 48 is a counter-rotating propeller device that includes a front propeller 50 designed to spin in one direction and to assert a forward thrust, and a rear propeller 52 designed to spin in the opposite direction and to assert a forward thrust. The counter-rotational propulsion device 48 will be explained in detail below.

The drive shaft 26 carries a drive gear 54 at its lower end, which is disposed within the lower unit 30 and which forms a portion of the transmission 42. The drive gear 54 preferably is a bevel type gear.

The transmission 42 also includes a pair of counter-rotating driven gears 56, 58 that are in mesh engagement with the drive gear 54. The pair of driven gears 56, 58 preferably are positioned on diametrically opposite sides of the drive gear 54, and are suitably journaled within the lower unit 30, as described below. Each driven gear 56, 58 is positioned at about a 90° shaft angle with the drive gear 54. That is, the propulsion shafts 44, 46 and the drive shaft 26, desirably intersect at about a 90° shaft angle; however, it is contemplated that the drive shaft 26 and the propulsion shafts 44, 46 can intersect at almost any angle.

In the illustrated embodiment, the pair of driven gears 56, 58 are a front bevel gear and an opposing rear bevel gear. The front gear 56 includes a hub which is journaled within the lower unit 30 by a front thrust bearing. The front thrust bearing rotatably supports the front gear 56 in mesh engagement with the drive gear 54. The hub has a central bore through which the inner propulsion shaft 44 passes when assembled. The inner propulsion shaft 44 is suitably journaled within the central bore of the front gear hub.

The front gear 56 also includes a series of teeth formed on an annular rear facing engagement surface. The teeth positively engage a portion of a clutch of the transmission 42, as discussed below.

As seen in FIG. 2, the rear gear 58 also includes a hub 59 which is suitably journaled by a rear bearing within a bearing carrier 60 located within the lower unit 30. The rear bearing rotatably supports the rear gear 58 in mesh engagement with the drive gear 54.

The hub 59 of the rear gear 58 has a central bore through which the inner propulsion shaft 44 and the outer propulsion shaft 46 pass when assembled. The rear gear 58 also includes an annular front engagement surface and an annular rear engagement surface. Each engagement surface carries a series of teeth for positive engagement with a transmission clutch, as discussed below.

The transmission 42 includes a front dog clutch 62 and a rear dog clutch 64 coupled together in a known manner. The front dog clutch 62 lies between the front and rear gears 56, 58 and selectively couples the inner propulsion shaft 44 either to the front gear 56 or to the rear gear 58. The rear dog clutch 64 lies behind the rear engagement surface of the rear gear 58 and selectively couples the outer propulsion shaft 46 to the rear gear 58. FIG. 2 illustrates the front dog clutch 62 and the rear dog clutch 64 set in a neutral position (i.e., in a position in which the clutches 62, 54 do not engage either the front gear 56 or the rear gear 58).

A spline connection couples the front dog clutch 62 to the inner propulsion shaft 44. Internal splines of the front dog clutch 62 matingly engage external splines on the external surface of the inner propulsion 44. This spline connection provides a driving connection between the front clutch 62 and the inner propulsion shaft 44, and permits the front clutch 62 to slide over the inner propulsion shaft 44.

The rear dog clutch 64 similarly is splined to the outer propulsion shaft 46. This spline coupling establishes a drive connection between the rear clutch 64 and the outer shaft 46, yet permits the clutch 62 to slide along the axis of the shaft 46.

With reference to FIG. 2, a conventional actuator mechanism 66 operates the clutches 62, 64 from a position in which the front and rear dog clutches 62, 64 engage the front and rear gears 56, 58, respectively, through a position of nonengagement (i.e., the neutral position), and to a position in which the front dog clutch 62 engages the rear gear 58. The actuator mechanism 66 positively reciprocates the clutches 62, 64 between these positions.

In the illustrated embodiment, the actuator mechanism 66 is configured generally in accordance with the disclosure of U.S. Pat. No. 5,449,306, entitled "Shifting Mechanism For Outboard Drive," issued on Sep. 12, 1995 to the assignee hereof, which is hereby incorporated by reference. Because the actuator mechanism 66 is believed to be conventional, further description of the actuator mechanism 66 is thought unnecessary for an understanding of the present invention.

The bearing carrier 60 supports the propulsion shafts 44, 46 behind the transmission 42. In the illustrated embodiment, a front needle bearing assembly journals a front end of the outer propulsion shaft 46 within the bearing carrier 60. A rear needle bearing assembly also supports the outer propulsion shaft 46 within the bearing carrier 60 at an opposite end of the bearing carrier 60 from the front bearing assembly.

The inner propulsion shaft 44, as noted above, extends through front gear hub and the rear gear hub, and is suitably journaled therein. On the rear side of the rear gear 58, the inner shaft 44 extends through the outer shaft 46 and is suitably journaled therein by a needle bearing which supports the inner shaft 44 at the rear end of the outer shaft 46.

In the illustrated embodiment, the bearing carrier 60 lies within the lower unit 30, and more specifically within an exhaust discharge conduit 68 of the lower unit 30. The exhaust discharge conduit 68 forms a part of the exhaust system 12 and extends from an upper end of the lower unit 30 to an exhaust outlet 70 formed on a rear wall 72 of the lower unit. The exhaust outlet 70 desirably has an circular shape and a side wall of the outlet 70 supports an internal thread. The exhaust outlet 70 also generally is concentrically positioned with the propulsion shafts 44, 46 about a common drive axis of the shafts 44, 46.

The exhaust discharge conduit 68 communicates with an expansion chamber (not shown) formed in the drive shaft housing 28 (FIG. 1). The exhaust system 12 communicates with the engine of the marine drive 10 and conveys exhaust gases to the expansion chamber for silencing, as known in the art. From the expansion chamber, the exhaust gases are discharged through the exhaust discharge conduit 68 and the outlet 70, as described below.

As seen in FIG. 2, the bearing carrier 60 has a generally tubular shape with an enlarge front end 74. The front end 74 has a sufficient size to receive the bearing arrangement which supports the rear gear 58, the rear dog clutch 64 and the front end of the outer propulsion shaft 46. A generally tubular section 76 extends to the rear of the enlarged front end 74.

Figure 3:
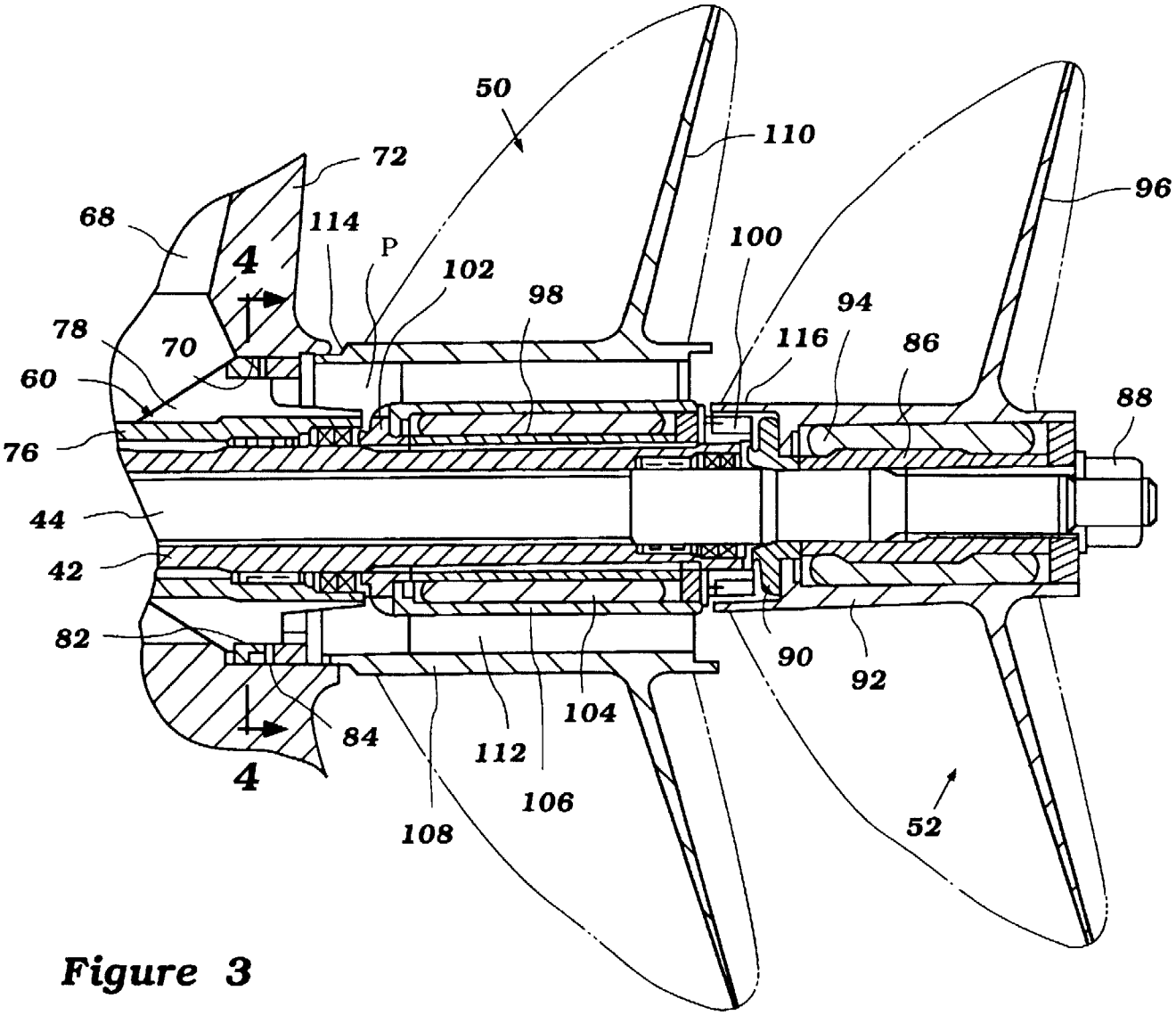
FIG. 3 is an enlarged sectional side elevational view of a rear portion of the lower unit and the propulsion device of FIG. 2.
Figure 4:
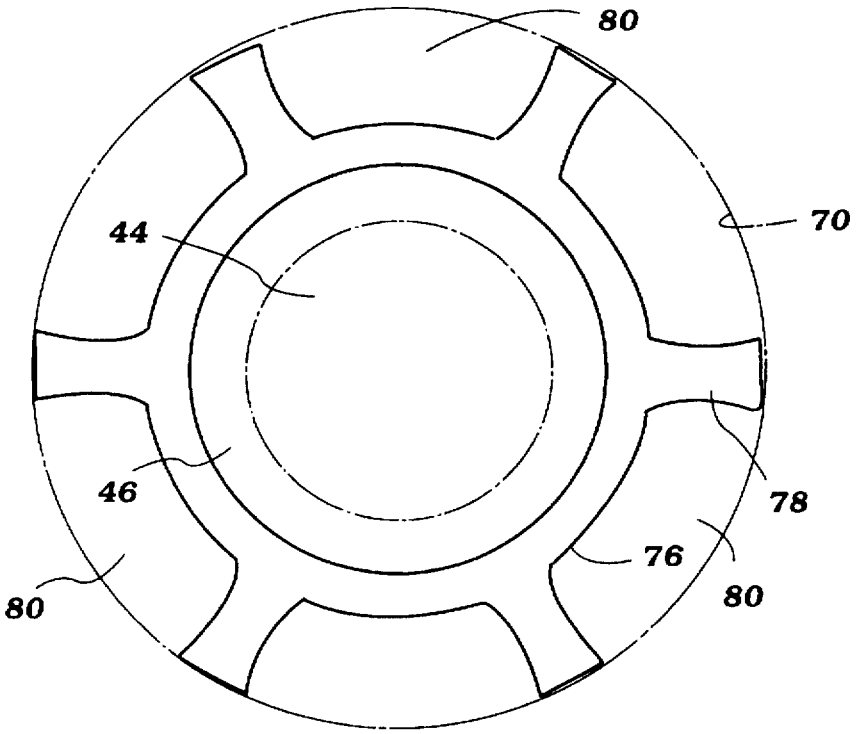
FIG. 4 is an enlarged cross-sectional view of a portion of the lower unit and a bearing carrier taken along line 4—4 of FIG. 3.

With references to FIGS. 3 and 4, a plurality of flanges 78 extend outwardly in radial directions from the rear tubular section 76 of the bearing carrier 60. As best seen in FIG. 4, a diameter defined between the outer ends of the flanges 78 generally equals an inner diameter of the exhaust outlet 70. The flanges 78 locate the tubular section 76 of the bearing carrier 60 in a position generally aligning a longitudinal axis of the bearing carrier 60 with the common axis of the propulsion shafts 44, 46 when the flanges 78 are positioned within the exhaust outlet 70.

As seen in FIG. 4, the flanges 78 define a plurality of apertures 80 between the flanges 78, the tubular section 76 of the bearing carrier 60, and the inner wall of the exhaust opening 70. Exhaust gases pass through these apertures 80 when discharged through the opening 70, as described below. The apertures 80 are arranged in an annular shape about the tubular section 76 of the bearing carrier 60.

With reference to FIG. 3, each flange 78 includes a recess 82 at its tip which defines an abutment surface. The recess is sized to receive at least a portion of a retainer ring 84 that secures the bearing carrier 60 to the lower unit 30. The retainer ring 82 includes an external thread that cooperates with the thread of the exhaust outlet 70. The retainer ring 82 is screwed into the exhaust outlet 70 to a point abutting the abutment surfaces of the flanges 78 to hold the bearing carrier 60 in place.

With reference to FIGS. 2 and 3, the inner shaft 44 extends beyond the rear end of the outer shaft 46. The rear end of the inner shaft 44 carries an engagement sleeve 86 of the rear propeller 52. The engagement sleeve 86 has a spline connection with the rear end of the inner shaft 44. The sleeve 86 is fixed to the inner shaft rear end between a retaining washer secured by a nut 88 threaded on the rear end of the shaft 44 and a rear thrust washer 90 that engages the inner shaft 44 proximate to the rear end of the outer shaft 46.

The inner shaft 44 also carries a rear propeller hub 92. An elastic bushing 94 is interposed between the engagement sleeve 86 and the propeller hub 92 and is compressed therebetween. The bushing 94 is secured to the engagement sleeve 86 by a heat process known in the art. The frictional engagement between the hub 92, the elastic bushing 94, and the engagement sleeve 86 is sufficient to transmit rotational forces from the sleeve 86, driven by the inner propulsion shaft 44, to propeller blades 96 attached to the propeller hub 92.

The outer shaft 46 carries the front propeller 50 in a similar fashion. As best seen in FIG. 3, the rear end portion of the outer shaft 46 carries a second engagement sleeve 98 in driving engagement thereabout by a spline connection. The second engagement sleeve 98 is secured onto the outer shaft 46 between a retaining ring 100 and a front thrust washer 102.

A second annular elastic bushing 104 surrounds the second engagement sleeve 98. The bushing 104 is secured to the sleeve 98 by a heat process known in the art.

An inner propeller hub 106 of the front propeller 50 surrounds the elastic bushing 104, which is held under pressure between the hub 106 and the sleeve 98 in frictional engagement. The frictional engagement between the propeller hub 106 and the bushing 98 is sufficient to transmit a rotational force from the sleeve 98 to propeller hub 106.

The front propeller 50 also includes an outer propeller hub 108 to which at least one propeller blade 110 is integrally formed. A plurality of radial ribs 112 extend between the inner hub 106 and the outer hub 108 to support the outer hub 108 about the inner hub 106 and to form passages P through the propeller 52. Engine exhaust is discharged through these passages P, as described below.

As seen in FIG. 3, the outer hub 108 includes an annular step 114 formed at its front end. The step 114 permits the front end of the propeller 50 to fit within the exhaust opening 70 with a portion of the rear wall of the lower unit 72 overlapping in the axial direction the front portion of the propeller hub 108. In this position, the exhaust passages P communicate with the exhaust discharge conduit 68 through the apertures 80 (see FIG. 4) defined between the flanges 78 of the bearing carrier 60 and the side wall of the exhaust outlet 70.

An inner diameter of the front propeller outer hub 108 is larger than an outer diameter of the hub 92 of the rear propeller 52. The exhaust passage P through the front propeller 50 terminates at a rear end of the propeller 50 and discharges exhaust gases in front of the rear propeller blades 96. The exhaust system 12 therefore discharges exhaust gases in the vicinity of the juxtaposed ends of the front and rear propellers 50, 52.

As seen in FIG. 3, a rear end of the front propeller inner hub 106 and a front end of the rear propeller hub 92 generally lie adjacent to each other so as to generally enclose the rear end of the outer propulsion shaft 46, the retainer ring 100, and the rear thrust washer 90. In the illustrated embodiment, the rear propeller hub 92 includes an annular lip 116 at its front. The lip 116 extends about the front thrust washer 90 and a portion of the retaining ring 100.

In the illustrated embodiment, the diameter of the inner hub 106 generally equals the diameter of the hub 92 of the rear propeller 52. That is, the diameters of the hubs 106, 92 do not vary by more the 25 percent of the smaller of the two diameters; however, it is preferred that the diameters at the juxtaposed ends of the propeller hubs 106, 92 equal each other.

As seen in FIG. 3, the front and rear propellers 50, 52 desirably include a plurality of propeller blades, although a singe blade can be used. In the illustrated embodiment, the propellers each include four blades which are integrally formed with the respective outer hub.

In operation, the exhaust system 12 conveys exhaust gases from the engine to the exhaust discharge conduit 68 in the lower unit 30. The exhaust gases flow through the exhaust outlet 70 into the passages P within the front propeller 50. A discharge end of the exhaust system 12 lies at the rear end of the front propeller 50, between the propeller blades of the first and second propellers 50, 52.

Figure 5A:
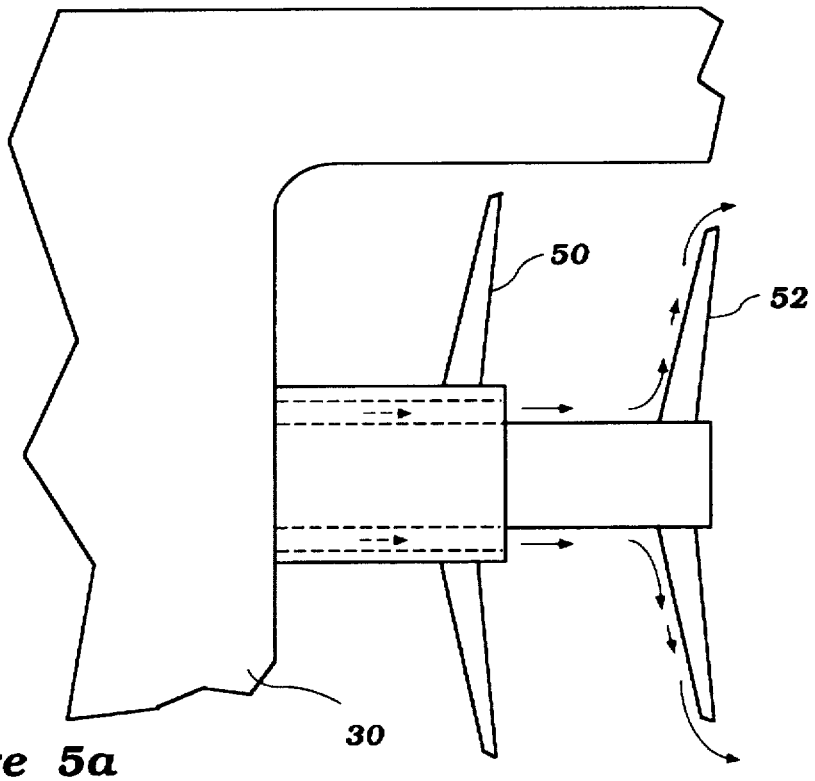
FIGS. 5*a* and 5*b* are schematic illustrations of the operation of the exhaust discharge system and the propulsion device when accelerating from a low speed and when running at a high speed (e.g., planing speed), respectively.

At low propeller speeds, the exhaust gases discharged between the propellers 50, 52 aerate the water around the propeller blades 96 of the rear propeller 52. As schematically illustrated in FIG. 5*a*, the action of the blades 96 of the propeller 52 drives the exhaust gases outwardly away from the hub 92 of the propeller 52. The exhaust gases flow over the blade back of the propeller blades 96 and become entrained in the water stream through the propeller 52.

Aeration or cavitation produced by the entrained exhaust gases within the water decreases the viscosity of the water around the blades 96 to reduce drag resistance on the blades 96. This permits the propeller 52 to accelerate more rapidly. Less propeller resistance in turn reduces the load applied by the rear propeller 52 on the engine, and more power is available to drive the front propeller 50. The marine drive 10 consequently accelerates quicker.

Figure 5B:
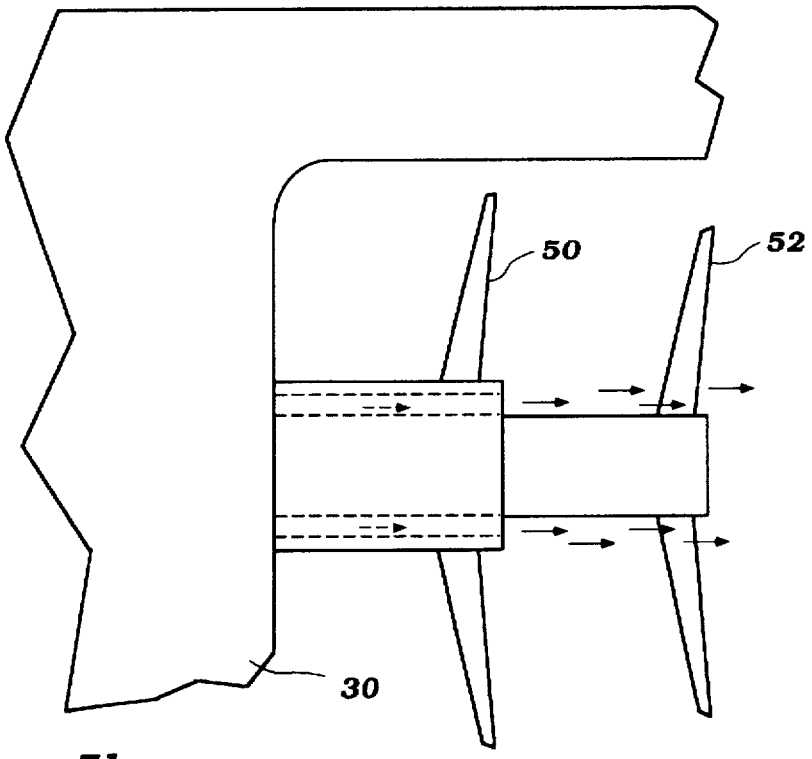

Water speed over the rear propeller 52 increases with rising engine and propeller speeds. As illustrated in FIG. 5*b*, the exhaust gases tend to flow over the rear propeller hub 92 and have less effect on cavitation. The speed of the exhaust gases, as well as the speed of the water flow over the propellers, carries the gasses through the rear propeller 52 in the vicinity of the bases of the propeller blades 96. As a result, discharge of exhaust gases between the propellers 50, 52 causes no significant loss of propulsion efficiency when traveling at high speeds.

The discharge of exhaust gases between the propellers 50, 52 also shortens the length of the exhaust system 12 which reduces back pressure within the exhaust system 12. Engine performance consequently improves as less pressure resists the discharge of exhaust gases from the engine cylinders.

The following additional embodiments illustrate further variants of the exhaust system 12 in which exhaust gases are discharged to create some cavitation effect around the blades of the rear propeller. In addition, the following embodiments are intended for use with a marine drive 10 in which the propellers are run partially surfaced. That is, the propellers run at least partially above the surface of the water in which the watercraft 16 is operated. In this application, the exhaust systems of the following embodiments maintain submerged discharge of exhaust gases to silence exhaust noise.

Figure 8:
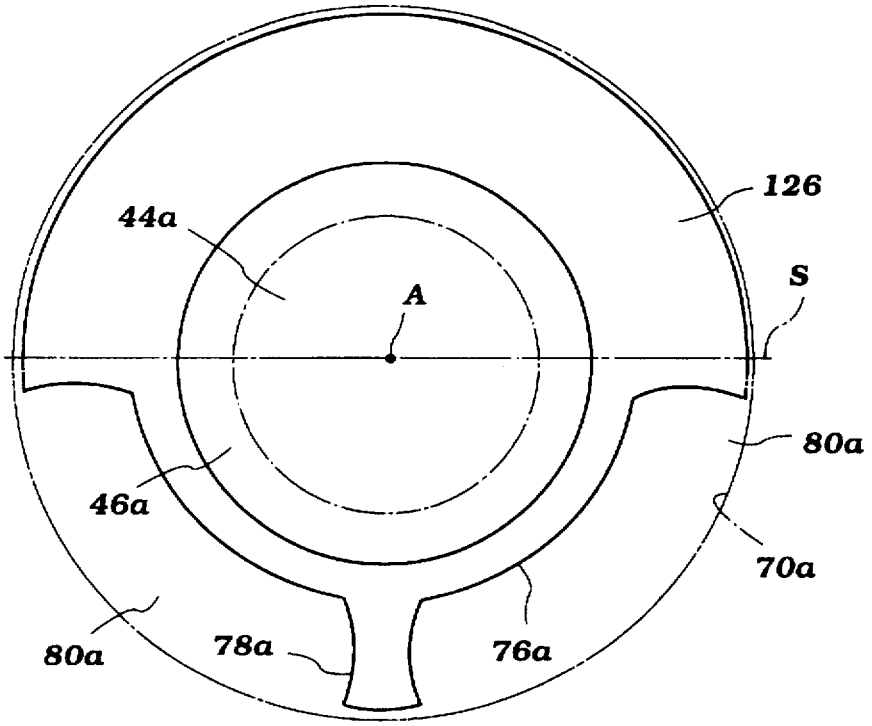
FIG. 8 is an enlarged cross-sectional view of a portion of the lower unit and a bearing carrier taken along line 8—8 of FIG. 7.
Figure 6:
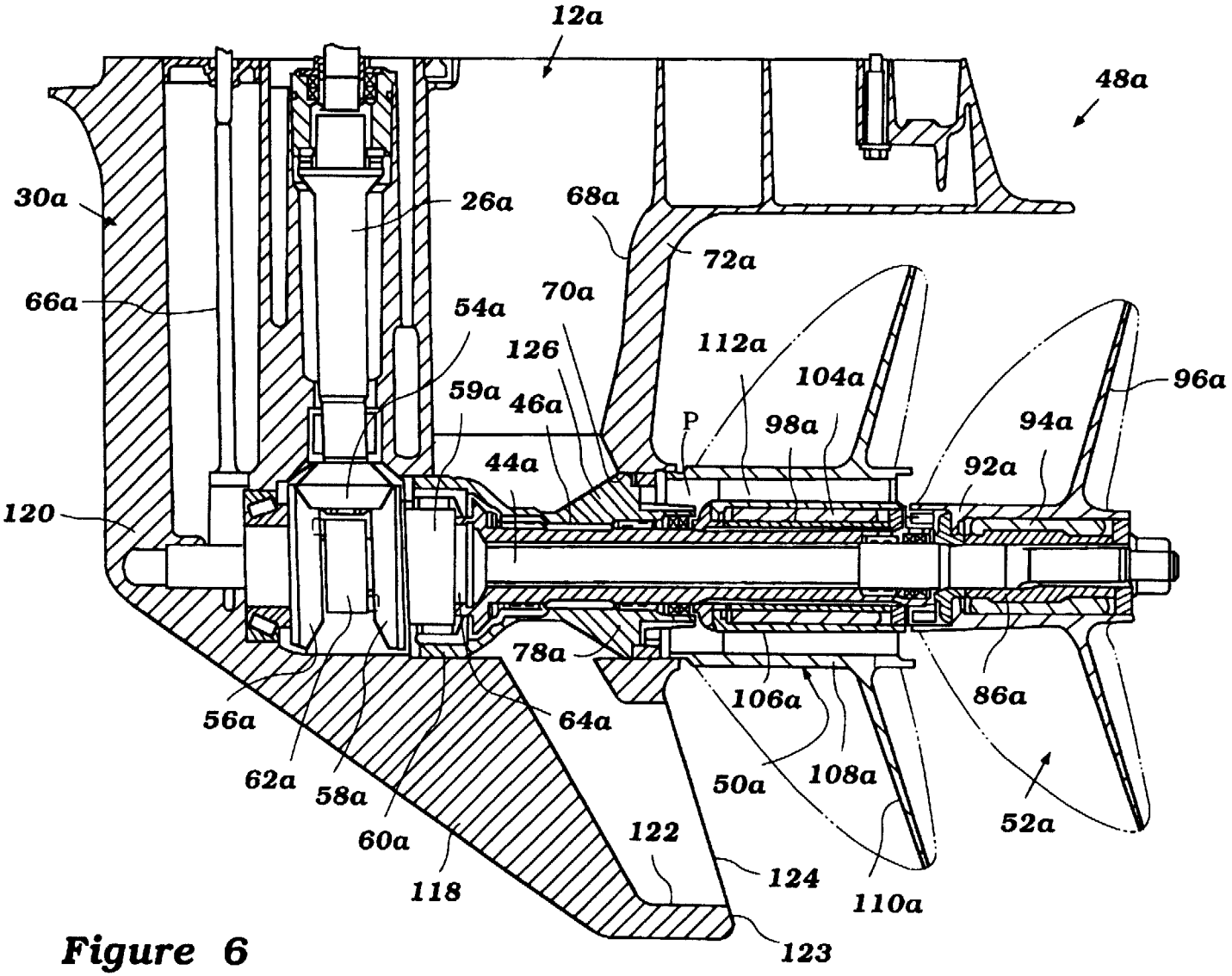
FIG. 6 is a side elevational view of a lower unit and a propulsion device of a marine drive configured in accordance with another embodiment of the present invention.
Figure 7:
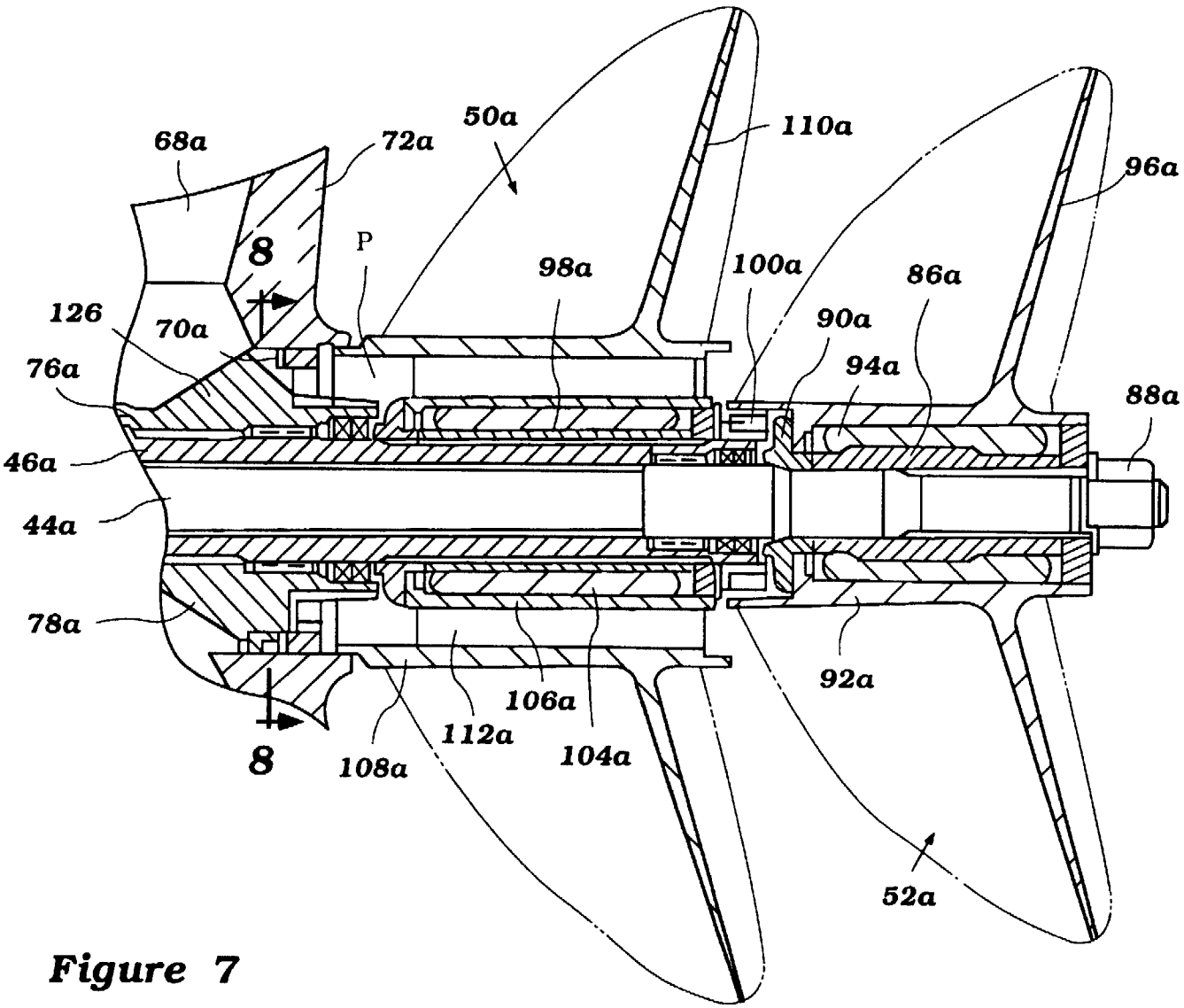
FIG. 7 is an enlarged sectional side elevational view of a rear portion of the lower unit and the propulsion device of FIG. 6.

FIGS. 6 through 8 illustrate another embodiment of the present invention. The embodiment of FIGS. 6 through 8 differ from the above-described embodiment only in the construction of the bearing carrier and the addition of a secondary exhaust passage within the lower unit. The description of the present embodiment therefore will be limited to these differences, with the understanding that the above description of common elements applies equally to the embodiment of FIGS. 6 through 8, unless specified to the contrary. For this reason, like reference numerals with an "a" suffix have been used to indicate like parts between the embodiments.

As seen in FIG. 6, the lower unit 30*a* includes a skeg 118 that extends below a nacelle 120. The nacelle 120 of the lower unit 30*a* houses the transmission 42*a* and the propulsion shafts 44*a*, 46*a*. The skeg 118 has a streamline shape and functions as a rudder, as known in the art.

A secondary exhaust passage 122 extends through the skeg 118 and terminates at a discharge end 124 on the exterior of the skeg 118. In the illustrated embodiment, the discharge end 124 opens on a rear edge 123 of the skeg 118 and extends from a point near the base of the front propeller blades 110*a* to a point below the tips of the propeller blades 110*a*.

The opposite end of the secondary exhaust passage 122 communicates with the exhaust discharge conduit 68*a*. The exhaust passage 122 desirably extends downwardly from the exhaust discharge conduit 68*a* at a point below the bearing carrier 60*a*.

With reference to FIGS. 7 and 8, the bearing carrier 60*a* includes a wall portion 126 which encloses an upper portion of the exhaust outlet 70*a* in the rear wall 72*a* of the lower unit 30*a*. As seen in FIG. 8, the wall 126 extends between the tubular section 76*a* of the bearing carrier 60*a* and the side wall of the outlet opening 70*a*. The degree to which the wall 126 extends about the circumference of the tubular section 76*a* depends upon the desired mount height of marine drive 10*a* on the watercraft transom 14*a*. For instance, where the common drive axis A of the propulsion shafts 44a, 46a lies at the water level S when the watercraft 16 is up on plane, as illustrated in FIG. 8, the wall 126 extends around the tubular section 76a to complete cover the exposed section of the exhaust outlet 70a (i.e., the section of the outlet 70a that lies above the water line S) . In this manner, exhausts gases flow only through a submerged portion of the exhaust opening 70a in order to discharge exhaust gases to the water, rather than directly to the atmosphere.

The bearing carrier 60a also includes at least one flange 78a positioned to support the bearing carrier 60a within the exhaust outlet 70a. In the illustrated embodiment, the flange 78a lies directly beneath the longitudinal axis of the bearing carrier 60a (i.e., beneath axis A).

Like the above embodiment, a plurality of apertures 80a are defined between the ends of the wall portion 126, the tubular section 76a, the flange 78a and the side wall of the exhaust outlet 70a. Exhaust gases are discharged through these apertures 80a and flow into exhaust passages P of the front propeller 50a. The exhaust passages P communicate with the exhaust outlet 70a only when they rotate beneath the water level.

In the illustrated embodiment, the apertures 80a defined within the outlet opening 70a are positioned generally below the drive axis A of the coaxial propulsion shafts 44, 46. That is, the apertures 80a lie below a horizontal plane in which the drive axis A extends. This position facilitates the discharge of engine exhaust into the water for silencing.

The wall portion 126 and the flange 78a desirably are integrally formed with the tubular section 76a of the bearing carrier 60a. The diameter across the rear end of the bearing carrier 60a between an outer edge of the wall 126 and a tip of the flange 78a desirably is such that the bearing carrier's rear end snugly fits within the exhaust outlet 70a.

Similar to the above embodiment, exhaust gases are discharged between the propellers 50a, 52a to aerate the water around the rear propeller 52a and quicken the acceleration of the marine drive 10a, as discussed above. At high speeds, with the watercraft 16a on plane, the propellers 50a, 52a run partially exposed. The wall 126 prevents the discharge of exhaust gases through the exposed portion of the exhaust outlet 70a (i.e., the portion of the outlet 70a above the water level S). The wall 126 thus promotes the submerged discharge of exhaust gases behind the front propeller 50a. But at high speeds, however, no substantial cavitation effect occurs, as noted above.

A portion of the exhaust gases also flow through the secondary exhaust passage 122 that extends through the skeg 118 of the lower unit 30a. At high speeds, the exhaust gases tend to flow over the outer propeller hubs 108, 92 and produce minimal cavitations. As a result, discharge at this location causes no significant loss of propulsion efficiency when traveling at high speeds.

It is understood that the secondary exhaust passage 122 described in connection with the embodiment of FIG. 6 also can be used with the embodiment illustrated in FIG. 2. In that case, a portion of the exhaust gases flow through the exhaust outlet 70 around the bearing carrier 60, and a portion of the exhaust gases flow through the secondary exhaust passage 122.

Figure 9:
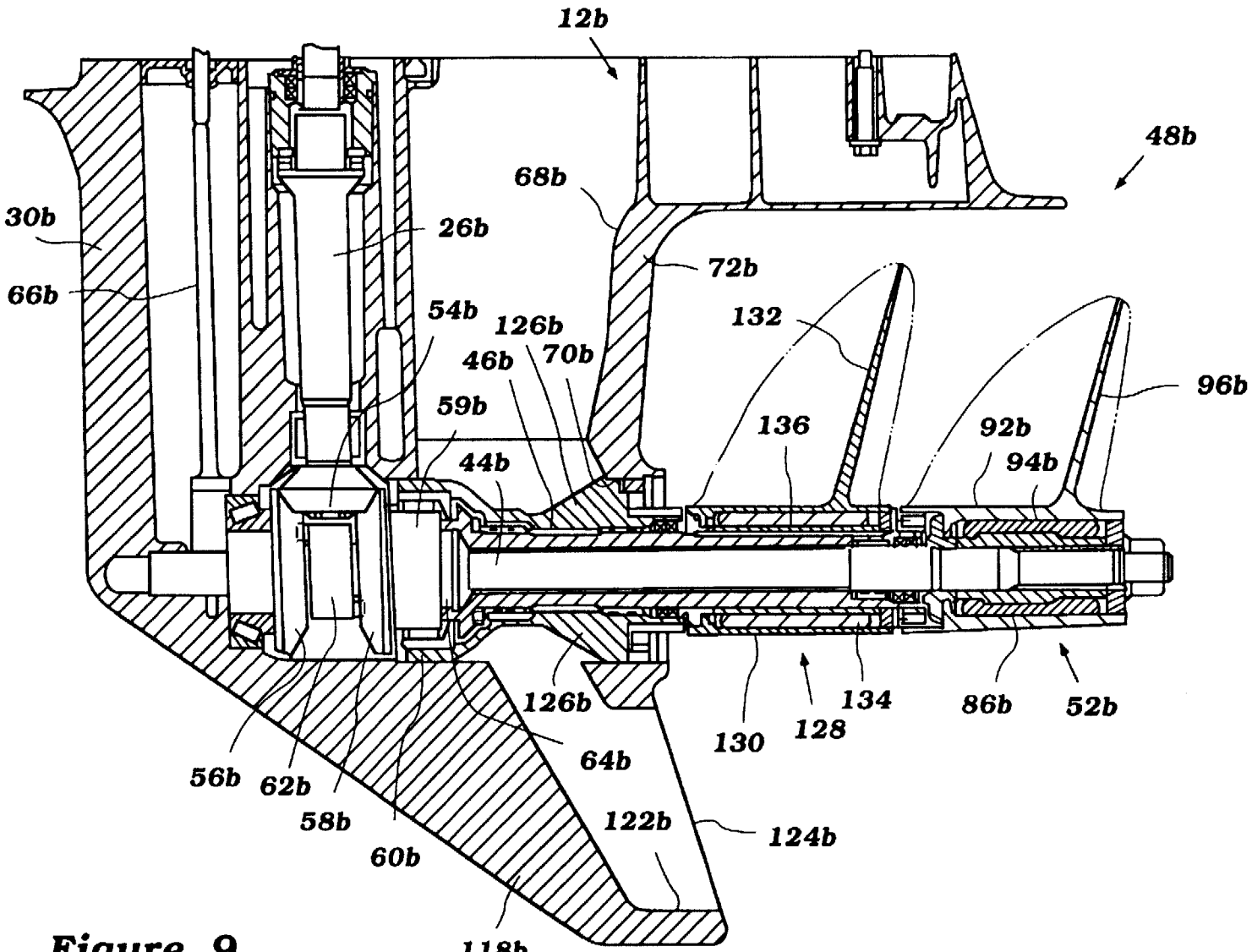
FIG. 9 is a side elevational view of a lower unit and a propulsion device of a marine drive configured in accordance with an additional embodiment of the present invention.

FIG. 9 illustrates an additional embodiment of the present exhaust system and propulsion device. This embodiment is substantially identical to the embodiment described in connection with FIGS. 6 through 8, except the wall portion of the bearing carrier substantially seals the entire outlet opening, and the exhaust passage through the front propeller has been eliminated. This embodiment is designed for use with an extremely high mounted marine drive in which the drive axis of the propulsion shafts lies above the water level.

In view of the limited differences between the embodiment of FIG. 6 and the embodiment of FIG. 9, the description of the present embodiment will be limited to the noted differences, with the understanding that the above description of like components applies equally to the embodiment of FIG. 9, unless specified to the contrary. For this reason, like reference numerals with a "b" suffix have been used to indicate like parts between the embodiments.

The wall portion 122b of the bearing carrier 60b completely circumscribes the tubular section 76b. The diameter of the wall section 122b is generally equal to the diameter of the exhaust outlet 70b such that the rear end of the bearing carrier 60b snugly fits within the outlet 70b. In this manner, the wall portion 126b closes the outlet opening 70b through which the propulsion shafts 44b, 46b pass.

In this embodiment, all exhaust gases flow through the exhaust passage 122b defined within the skeg 118b, not through a front propeller. The front propeller 128 therefore includes only an outer propeller hub 130 that supports at least one propeller blade 132. The hub 130 of the front propeller 128 is generally equal in size to the hub 92b of the rear propeller 52b.

An elastic bushing 134 is positioned within the propeller hub 130 and lies between the propeller hub 130 and an engagement sleeve 136. The bushing 134 is secured to the sleeve 136 by a heat process known in the art. The elastic bushing 134 also is held under pressure between the hub 130 and the sleeve 136 in frictional engagement. The frictional engagement between the propeller hub 130 and the bushing 134 is sufficient to transmit a rotational force from the sleeve 136 to blades 132 of the front propeller 128.

The rear end portion of the outer shaft 46b carries the second engagement sleeve 136 in driving engagement thereabout by a spline connection. The second engagement sleeve 136 is secured onto the outer shaft 46b between a retaining ring 100b and a front thrust washer 102b.

As common to the above embodiments, the exhaust system discharges exhaust gases at a location which produces a cavitation effect about the blades of at least one of the propeller for rapid acceleration from low speeds. In several of the embodiments, at least a portion of the exhaust gases are discharged between the propellers so as to limit the resulting cavitation effect to only to rear propeller. In U.S. patent application Ser. No. 08/318,056, U.S. Pat. No. 5,529,520, entitled "Propulsion System For Marine Vessel," filed in the names of Takashi Iwashita, Yashushi Iriono, Yoshitugu Sumino and Hiroshi Harada, on Oct. 4, 1994, and assigned to the assignee hereof, which is hereby incorporated by reference, several embodiments of an exhaust system are discloses in which the front propeller is exposed cavitations produced by exhaust gases. In either case, a marine drive employing a counter-rotational propeller system and one of the disclosed exhaust systems is able to accelerate more rapidly in comparison with prior marine drive designs.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A marine drive for a watercraft including a propulsion device comprising a front propeller and a rear propeller intended to rotate in opposite directions about a common rotational axis, each of said propellers including a tubular outer hub from which at least one propeller blade extends, said outer hub of said front propeller having an inner diameter extending along an entire length of the front propeller outer hub and being sized such that at any point along the length of the front propeller outer hubs the inner diameter is larger than an outer diameter of said rear propeller hub.

2. A marine drive as in claim 1, wherein said front propeller additionally comprises an inner hub positioned within said outer hub so as to define an exhaust passage between said inner hub and said outer hub.

3. A marine drive as in claim 2, wherein an outer diameter of said inner hub of said front propeller is generally equal in size to said outer diameter of said rear propeller hub.

4. A marine drive as in claim 2, wherein said propellers are intended to be supported by a lower unit of said marine drive, and said exhaust passage communicates with an exhaust outlet of said lower unit.

5. A marine drive as in claim 4, wherein said propellers are intended to run partially surfaced, and only a lower portion of said exhaust passage of said front propeller communicates with said exhaust outlet.

6. A marine drive as in claim 4, wherein said lower unit defines a second exhaust outlet located at a point beneath said common rotational axis of said propellers.

7. A marine drive as in claim 6, wherein said second exhaust outlet is located on a skeg of said lower unit.

8. A marine drive for a watercraft including an engine driving a propulsion device under at least a forward drive condition, the propulsion device comprising a front propeller and a rear propeller which are juxtaposed and rotate in opposite directions about a common rotational axis, each propeller including at least one blade having a tip and a base, and an exhaust system communicating with said engine and conveying exhaust gases from said engine to a discharge end of said exhaust system, said discharge end being positioned to discharge exhaust gases in the vicinity of juxtaposed ends of said front and rear propellers closer to a base than to a corresponding tip of at least one blade of one of said front and rear propellers with the propulsion device operating under at least the forward drive condition.

9. A marine drive as in claim 8, wherein said discharge end of said exhaust system lies between said at least one blade of said front propeller and said at least one blade of said rear propeller.

10. A marine drive as in claim 9, wherein said front propeller includes an exhaust passage which forms a portion of said exhaust system, and said discharge end lies at a rear end of said exhaust passage.

11. A marine drive as in claim 10, wherein said exhaust passage of said front propeller is formed between an inner hub and an outer hub of said front propeller.

12. A marine drive as in claim 11, wherein said rear propeller includes an outer hub from which said at least one blade extends, and an outer diameter of said rear propeller outer hub is smaller than an inner diameter of said outer propeller hub of said front propeller.

13. A marine drive as in claim 12, wherein said outer diameter of said rear propeller outer hub generally equals an outer diameter of said inner hub of said front propeller.

14. A marine drive as in claim 11, wherein said exhaust passage communicates with an exhaust discharge conduit formed in a submerged casing of said marine drive.

15. A marine drive as in claim 14, wherein said front and rear propellers are intended to run partially surfaced, and a wall extends between a portion of said exhaust discharge conduit and a portion of said exhaust passage such that only a submerged portion of said exhaust passage communicates with said exhaust discharge end.

16. A marine drive as in claim 15, wherein said exhaust system includes a second exhaust discharge end that opens on an exterior of a skeg of said submerged casing.

17. A marine drive as in claim 16, wherein said second exhaust discharge end lies at a rear end of said skeg.

18. A marine drive for a watercraft comprising an engine driving a propulsion device including a first propeller, said first propeller rotating about a drive axis, and an exhaust system communicating with said engine and discharging exhaust gases through said first propeller, said exhaust system comprising an exhaust discharge conduit formed within a lower unit which supports said propulsion device, and an annular exhaust passage formed within said first propeller and communicating with an outlet of said exhaust discharge conduit, said outlet being located generally below said drive axis.

19. A marine drive as in claim 18, wherein said lower unit supports said propulsion device such that said propeller runs at least partially surfaced, and said outlet of said exhaust discharge conduit communicates only with a submerged portion of said exhaust passage of said propeller.

20. A marine drive as in claim 19, wherein said exhaust outlet is formed by an annular opening disposed on a rear side of said lower unit about said drive axis, and a wall positioned within said opening to close at least an upper portion of said annular opening.

21. A marine drive as in claim 20, wherein said exhaust discharge conduit includes another exhaust outlet that opens on an exterior of a skeg of said lower unit which lies below said drive axis.

22. A marine drive as in claim 18, wherein said propulsion device includes a second propeller positioned behind the first propeller and intended to rotate about the drive axis but in an opposite direction to the rotational direction of the first propeller.

23. A marine drive as in claim 22, wherein said propellers each include propeller blades, and said propeller exhaust passage terminating at a point between the propeller blades of said propellers.

24. A marine drive for a watercraft comprising an engine driving a propulsion device including at least one propeller, a lower unit supporting said propeller to rotate about a drive axis and in a position to run at least partially exposed above a surface of a body of water in which the watercraft is operated when said watercraft is up on plane, and an exhaust system communicating with said engine and discharging exhaust gases through said propeller, said exhaust system comprising an annular discharge opening defined on a rear side of said lower unit, said annular opening positioned about said drive axis, an exhaust passage formed within said propeller and positioned about said drive axis in a position juxtaposing an inlet to said exhaust passage with said annular opening of said lower unit, and a wall covering at least a portion of said annular opening which is exposed above the surface of the water when the watercraft is up on plane.

25. A marine drive as in claim 24, wherein said exhaust system additionally comprises an exhaust discharge conduit which communicates with said annular opening of said lower unit, said discharge conduit also extending below said drive axis into a skeg of said lower unit and terminating at a discharge end located at a rear end of said skeg.

26. A marine drive as in claim 24, wherein said propulsion device includes a second propeller of opposite hand to the other propeller, said propellers are juxtaposed with one propeller being positioned in front of the other and being arranged such that both propellers rotate about said drive axis, each of said propellers includes a tubular outer hub from which at least one propeller blade extends, and said outer hub of the propeller in front of the other has an inner diameter that is larger than an outer diameter of the other propeller hub.

27. A marine drive for a watercraft including an engine driving a propulsion device comprising a front propeller and a rear propeller which are juxtaposed and rotate in opposite directions about a common rotational axis, and an exhaust system communicating with said engine and conveying exhaust gases from said engine to an exterior discharge end of said exhaust system at which the exhaust system terminates, said front propeller including a tubular outer hub and a tubular inner hub, said exterior discharge end being defined by and between said inner and outer hubs and being located in the vicinity of the juxtaposed ends of said front and rear propellers.

28. A marine drive as in claim 27, wherein said front and rear propellers each include at least one blade, and said discharge end of said exhaust system lies between said at least one blade of said front propeller and said at least one blade of said rear propeller.

29. A marine drive as in claim 27, wherein said front propeller includes an exhaust passage which forms a portion of the exhaust system, and the discharge end lies at a rear end of the exhaust passage.

30. A marine drive as in claim 27, wherein the rear propeller includes an outer hub from which said at least one blade extends, and an outer diameter of the rear propeller outer hub is smaller than an inner diameter of the front propeller outer hub at any point along the length of the front propeller outer hub.

* * * * *

UNITED STATES PATENT AND TRADEMARK OFFICE

CERTIFICATE OF CORRECTION

PATENT NO. : 5,766,048

DATED : June 16, 1998

INVENTOR(S) : Takashi Iwashita

It is certified that error appears in the above-identified patent and that said Letters Patent is hereby corrected as shown below:

In Claim 1, column 11, line 7, "outer hubs" should be --outer hub--.

Signed and Sealed this

Nineteenth Day of January, 1999

*Attest:*

*Acting Commissioner of Patents and Trademarks*

*Attesting Officer*